US005103706A

United States Patent [19]

Rosemann

[11] Patent Number: 5,103,706

[45] Date of Patent: Apr. 14, 1992

[54] MARGIN HOLE PUNCH LOCKING APPARATUS

[76] Inventor: Richard Rosemann, 456 South Clay, Kirkwood, Mo. 63122

[21] Appl. No.: 664,083

[22] Filed: Mar. 4, 1991

[51] Int. Cl.[5] ..... B26F 1/10

[52] U.S. Cl. ..... 83/670; 83/345; 83/698

[58] Field of Search ..... 83/669, 670, 677, 698, 83/699, 700, 345, 665; 403/316, 317

[56] References Cited

U.S. PATENT DOCUMENTS

| | | | |
|---|---|---|---|
| 2,598,649 | 5/1952 | Rintoul | 83/698 X |
| 3,106,859 | 10/1963 | Huffman | 83/670 X |
| 3,828,632 | 8/1974 | Grano | 83/698 X |
| 4,434,690 | 3/1984 | Mauer | 83/698 X |
| 4,594,926 | 6/1986 | Propheter | 83/670 X |
| 4,604,931 | 8/1986 | Bastian et al. | 83/665 |
| 4,688,459 | 8/1987 | Osborn et al. | 83/698 |

*Primary Examiner*—Frank T. Yost
*Assistant Examiner*—Eugenia A. Jones
*Attorney, Agent, or Firm*—Rogers, Howell & Haferkamp

[57] ABSTRACT

A rotary hole punching die assembly comprises a plurality of hole punch inserts mounted in radial holes circumferentially spaced around a punch wheel. A retainer ring having a plurality of projecting cogs engages the plurality of hole punch inserts and retains the inserts on the punch wheel. A clamping collar and key are assembled with the punch wheel and retainer ring on a rotary mandrel, and secure the punch wheel and retainer ring against axial and rotational movement relative to the mandrel. The rotary hole punching die assembly prevents any one hole punch insert from being disassembled from the assembly without removing the entire assembly from the rotary mandrel, and the entire assembly cannot be removed from the mandrel without first removing the mandrel, along with the assembly, completely from the rotary press.

29 Claims, 1 Drawing Sheet

FIG. 1.
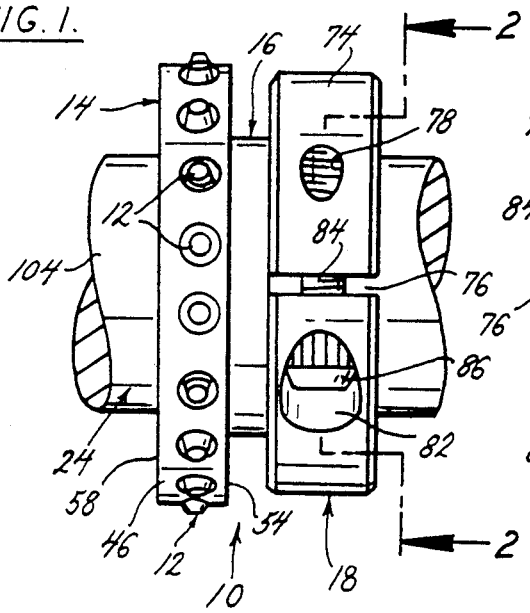
FIG. 2.
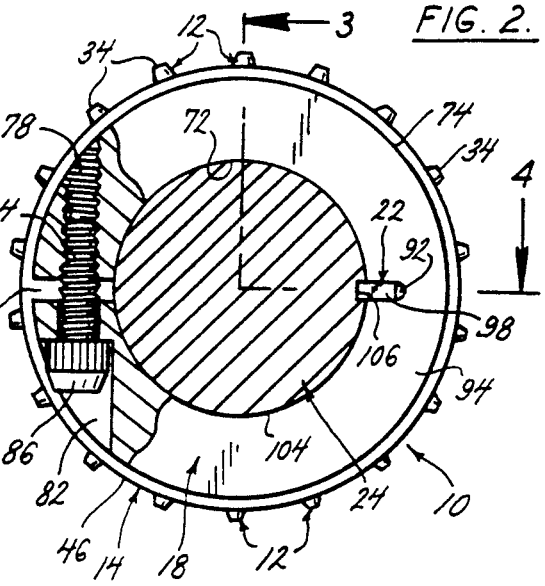
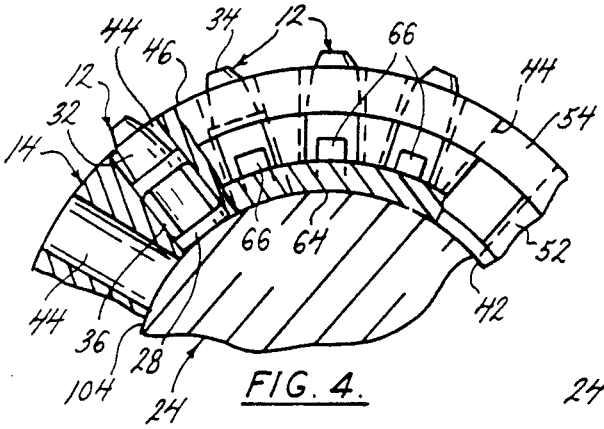
FIG. 4.
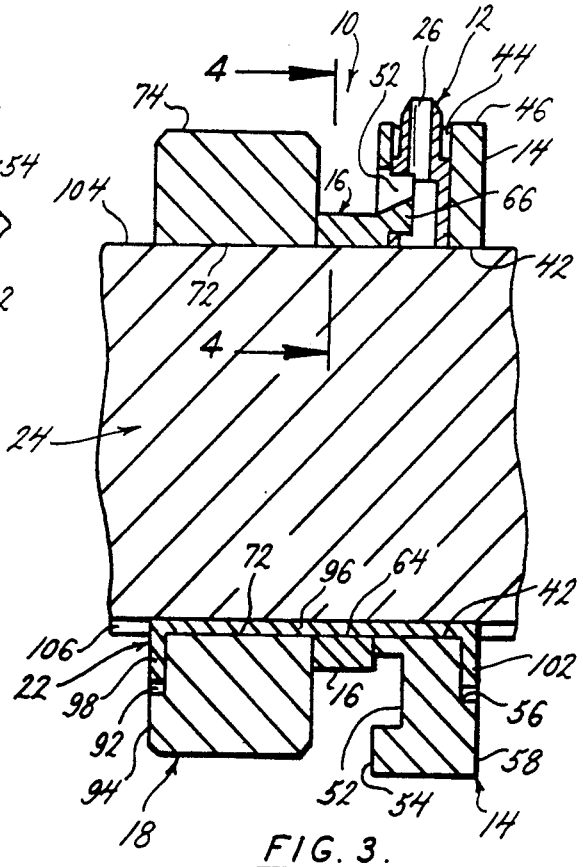
FIG. 3.
FIG. 5.
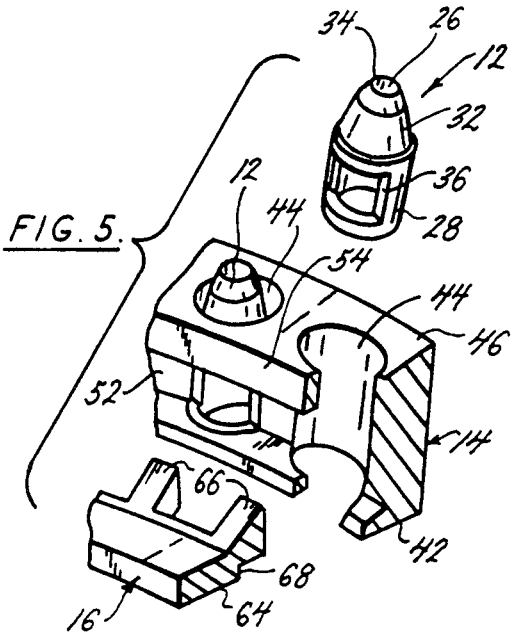

MARGIN HOLE PUNCH LOCKING APPARATUS

BACKGROUND OF THE INVENTION (1) Field of the Invention

The present invention relates to a rotary hole punching die assembly and a hole punch insert locking arrangement for such an assembly. In particular, the invention pertains to a rotary hole punching die assembly comprised of a plurality of hole punch inserts, a punch wheel, a retainer ring, a clamping collar, a key, and a rotary mandrel. The plurality of punch inserts are assembled on the punch wheel and are retained on the wheel by the retainer ring. The punch wheel with mounted inserts and the retainer ring are then assembled with the clamping collar and key on the mandrel and are secured on the mandrel by the clamping collar and key.

(2) Description of the Related Art

Prior art rotary hole punching die assemblies commonly employ an annular collar that is secured in an adjusted position on a rotary mandrel. The collar is typically formed with a plurality of holes that extend radially into the collar from its periphery. A plurality of hole cutting punch inserts are inserted into the plurality of holes in the collar's periphery. Each of the inserts are radially adjusted so that they all extend a desired radial extent from the collar periphery. Set screws associated with each of the radial holes in the collar secure each of the individual hole punch inserts in their radially adjusted positions in the collar.

The rotary mandrel on which the annular collar of the prior art hole punching die assembly is mounted is commonly formed from a solid metal cylinder. The annular collar of the prior art hole punching die is slip fit over the mandrel and secured in a desired axial position thereon. The mandrels are formed with journal shafts of reduced diameters protruding from their opposite ends for mounting the mandrel for rotation on a hole punching press. A timing gear is mounted on one of the journal shafts.

The timing gear meshes with a gear on an anvil roll of the press. The anvil roll gear drives the timing gear and causes rotation of the mandrel and the hole punching die assembly mounted thereon. The rotation of the mandrel and hole punching die, the anvil roll, and other operations performed by the rotary cutting press operate in synchronism due to the meshing of the anvil gear with the timing gear.

In prior art rotary die cutting presses employing rotary hole punching die assemblies like that described above, the rotary mandrel, with the hole punching die assembly secured thereon, is mounted parallel to the rotating anvil roll on the press. The hole punching die assembly and anvil roll rotate against each other as a web of stock material is passed through the press between the rotating die and anvil. A pressure assist roll or a load carrying truck or tractor assembly is often employed to exert a downward force on the rotating mandrel supporting the hole punching die, causing the die to bear down against the anvil roll. As the material is passed between the rotating hole punching die and anvil roll, each of the individual hole punch inserts mounted in the die assembly cut a hole through the material. Prior art hole punching die assemblies such as that described are often used in cutting holes along the margins of paper as well as in other applications.

Prior art rotary hole punching die assemblies are disadvantaged in that each of the individual hole punching inserts mounted in the die assembly must be individually radially adjusted. Each of the individual hole punching inserts are then secured in their adjusted positions in the die assembly by tightening down the separate set screw for each insert. This set-up procedure is very exacting and is very time consuming.

Moreover, because each of the individual hole punching inserts mounted in the die assembly is held in its adjusted position by its own set screw, any one of the inserts could potentially cause damage and down time to the die cutting press by working loose from the die assembly and falling into the workings of the press. Furthermore, because the speed of rotation of the mandrel in cutting operations is often very high, should one of the hole punching inserts work loose from the die assembly, it could be thrown from the rotating mandrel and cause serious physical injury to a press operator standing nearby.

Accordingly, it would be advantageous to provide a rotary hole punching die assembly that quickly mounts a plurality of hole punch inserts on the die assembly with each of the individual inserts having a preset radial height adjustment. Furthermore, it would also be advantageous to provide a rotary hole punching die assembly in which the individual hole punching inserts mounted in the assembly could not be removed from the die assembly, either intentionally or inadvertently, without first removing the entire die assembly from the rotary cutting press, and then disassembling the die assembly at a work bench remote from the rotary cutting press. Such a rotary hole punching die assembly would substantially reduce the set up time for mounting the plurality of hole punch inserts at a desired predetermined radial height on the die assembly, and such a die assembly would substantially reduce the possibility of a hole punch insert working loose from the die assembly during cutting operations and causing damage to the cutting press or injury to the press operator.

SUMMARY OF THE INVENTION

The rotary hole punching die assembly of the present invention is generally comprised of a plurality of hole punch inserts, a punch wheel, a retainer ring, a clamping collar, a key and a rotary mandrel. The plurality of punch inserts are assembled on the punch wheel and are retained on the wheel by the retainer ring. The punch wheel with mounted inserts and the retainer ring are then assembled with the clamping collar and key on the mandrel and are secured on the mandrel by the clamping collar and key.

Each of the individual punch inserts is generally cylindrical and has a hollow internal bore. The inserts are tapered and honed at one end to form an annular hole cutting rim on the one end. The sides of the inserts have slots cut therein through to their internal bores. The axial position of the slot in the side of the insert determines the radial extent that the insert projects from the die assembly.

The plurality of inserts are mounted on the punch wheel. The punch wheel is formed as an annular ring with interior and exterior surfaces. A plurality of spacially arranged, radial holes extend through the annular wheel between its interior and exterior surfaces. An annular slot is formed in a lateral side of the punch wheel intersecting the plurality of radial holes. The plurality of punch inserts are received in the plurality of radial holes, and the insert slots are aligned with the annular slot of the punch wheel.

The retainer ring is an annular member having the same inner diameter as the punch wheel. A plurality of cogs project from one lateral side of the ring. The retainer ring is assembled to the punch wheel by extending the plurality of cogs into the annular slot of the punch wheel, and engaging each individual cog in a slot of the plurality of punch inserts mounted in the punch wheel. Each of the individual cogs has an exterior configuration that presents a sloping surface at the bottom of the insert internal bore into which the cog is inserted. The sloping surface of the cog exterior extends from inside the insert bore, through the slot in the side of the insert and through the annular ring in the lateral side of the punch wheel to a position outside the lateral side of the punch wheel. The sloping surface of the cog enables chaff circles cut be the apparatus to pass down through the internal bore of the insert and out the lateral side of the punch wheel along the sloping external surface of the cog.

The annular clamping collar has the same inner diameter as the punch wheel and retainer ring, and is assembled adjacent the side of the retainer ring opposite the punch wheel. The key is inserted through the interior bores of the clamping collar, retainer ring and punch wheel, and opposite legs of the key engage against opposite sides of the clamping collar and punch wheel to secure the collar, ring and wheel axially together.

The clamping collar, retainer ring, and punch wheel, secured together by the key, are slip fit on the rotary mandrel. The key engages in an axial slot on the exterior of the mandrel and secures the clamping collar, retainer ring and punch wheel against rotation relative to the mandrel. The assembled clamping collar, retainer ring and punch wheel are positioned axially on the rotary mandrel in a desired position, and the clamping collar is then secured to the mandrel, thereby securing the retainer ring and punch wheel to the mandrel.

In this manner, the plurality of hole punch inserts are mounted on the punch wheel with a preset radial extension from the punch wheel by the single retainer ring. The individual hole punch inserts may not be disassembled from the die assembly without first disassembling the retainer ring from the punch wheel. The retainer ring cannot be disassembled from the punch wheel without first disassembling the clamping collar, key, retainer ring and punch wheel from the rotary mandrel. The above described disassembly process for disassembling the punch hole inserts from the apparatus cannot be performed without first removing the entire apparatus from the rotary press. In this manner, the apparatus of the present invention eliminates the possibility of a hole punching insert causing damage or down time to the press by falling into the workings of the press when being adjusted because the entire apparatus is removed from the press in order to remove the inserts from the apparatus.

The rotary hole punching die assembly of the present invention is unique in that each of the individual hole punch inserts are radially adjusted together and are secured together on the punch wheel by the retainer ring. None of the individual hole punching inserts can be disassembled from the punch wheel without first disassembling the retainer ring from the punch wheel. The retainer ring cannot be disassembled from the punch wheel without removing the entire hole punching die assembly from the rotary press. In this manner, the rotary hole punching die assembly of the present invention avoids the prior art disadvantages of time consuming radial adjustment of the individual hole punching inserts, and the potential for one of the hole punching inserts working loose from the hole punching die assembly and causing damage to the rotary cutting press or injury to the press operator.

BRIEF DESCRIPTION OF THE DRAWINGS

Further objects and features of the present invention are revealed in the following detailed description of the preferred embodiment of the invention and in the drawing figures wherein:

FIG. 1 is a side elevation view of the rotary hole punching die assembly of the present invention assembled on a rotary mandrel;

FIG. 2 is an end elevation view, partially in section, of the rotary hole punching die assembly of the present invention taken along the line 2—2 of FIG. 1;

FIG. 3 is a side view in section of the hole punching die assembly of the present invention taken along the line 3—3 of FIG. 2;

FIG. 4 is a segmented view, partially in section, of the rotary hole punching die assembly of the present invention taken along the line 4—4 of FIG. 3; and FIG. 5 is a segmented perspective view showing the detail of the connections between the hole punch inserts, the punch wheel, and the retainer ring of the present invention.

DETAILED DESCRIPTION OF THE PREFERRED EMBODIMENT

The rotary hole punching die assembly 10 of the present invention is generally comprised of six different component parts, including: punch inserts 12, a punch wheel 14, a retainer ring 16, a clamping collar 18, a key 22, and a rotary mandrel 24. A plurality of the punch inserts 12 are assembled together with the punch wheel 14, the retainer ring 16, the clamping collar 18, and the key 22 on the mandrel 24.

One of the plurality of punch inserts 12 that make up part of the assembly of the invention is shown in FIG. 5. As seen in FIG. 5, each punch insert 12 is generally cylindrical and has a hollow internal bore 26 extending axially through its center. The exterior of each insert is formed with a cylindrical body portion 28 and a tapered portion 32 that extends upward from the body portion as viewed in FIG. 5. The distal end of the tapered portion 32 is honed to form a cutting annular rim 34. The annular rim 34 of the insert 12 cuts holes through sheet material. A slot 36 is cut into one side of the insert cylindrical body portion 28. As seen in FIG. 5, the slot 36 is cut completely through the side of the insert 12 to the insert internal bore 26. The axial position of the slot 36 in the side of the insert determines the radial extent that the insert projects from the die assembly 10. This will be apparent in the later description of the assembly of the invention.

The plurality of punch inserts 12 employed in the invention are mounted in the punch wheel 14. The punch wheel 14 is an annular wheel having a general rectangular cross section. An internal annular surface 42 defines a center bore of the wheel. A plurality of radial holes 44 extend through the wheel 14 from the inner surface 42 to the outer peripheral surface 46 of the wheel. The radial holes 44 are spatially arranged around the wheel, and each of the radial holes has an inner diameter dimensioned just large enough to allow the punch inserts 12 to be slip fit inside the holes.

An annular groove or slot 52 is formed in one lateral side 54 of the punch wheel 14. The annular slot 52 has a general rectangular cross section and extends far enough into the lateral side 54 of the punch wheel 14 to intersect with the plurality of radial holes 44 extending through the punch wheel. The radial position of the annular slot 52 in the side 54 of the punch wheel 14 exposes each of the slots 36 formed in the sides of the punch inserts 12 received in the radial holes 44 of the punch wheel. As is best seen in FIGS. 4 and 5, when the punch inserts 12 are inserted in the radial holes 44 of the punch wheel 14, the slots 36 formed in the sides of the punch inserts 12 are all accessible through the annular slot 52 formed in the side 54 of the punch wheel 14. A small groove 56 is formed in the lateral side 58 of the punch wheel opposite the annular slot 52. The groove 56 extends radially a short distance from the wheel inner surface 42.

The retainer ring 16 retains the plurality of punch inserts 12 in their positions inserted in the radial holes 44 of the punch wheel 14. The retainer ring 16 is also an annular ring having an inner annular surface 64 defining a center bore of the ring. A plurality of cogs 66 are spacially arranged on and project laterally from a lateral side 68 of the retainer ring 16. The circumferential spacing of the plurality of cogs 66 on the lateral side 68 of the retainer ring 16 corresponds to the circumferential spacing of the plurality of radial holes 44 through the punch wheel 14.

As seen in FIG. 5, the retainer ring 16 is assembled to the punch wheel 14 with the lateral side 68 of the retainer ring facing the lateral side 54 of the punch wheel. The plurality of cogs 66 projecting from the retainer ring 16 extend into the punch wheel slot 52 and engage in the slots 36 of the plurality of punch inserts 12 inserted in the radial holes 44 of the punch wheel. Each of the individual cogs 66 has an exterior surface configured to provide a sloping surface extending from the internal bore of the punch hole insert. The sloping surface is provided at the top of the individual cogs 66 as is best seen in FIGS. 3 and 5. As seen in the drawing figures, the top sloping surface of the cogs 66 extends from a position inside the insert bore 26 through the slot 36 in the side of the insert and through the annular slot 52 in the lateral side of the punch wheel 14, to a position just outside the lateral side of the punch wheel. As is apparent from viewing the drawing figures, the sloping top surface of the cog 66 causes chaff circles that are cut from paper by the apparatus and pushed through the interior bore 26 of the insert to pass over the sloping top surface of the cog 66, through the side slot 36 of the insert and the annular slot 52 of the punch wheel, and out the lateral side of the punch wheel. This construction prevents cut chaff from building up inside of the insert internal bore. The cog 66 also serves in maintaining the position of the insert slots 36 toward the annular slot 52 of the punch wheel to facilitate the exiting of cut chaff from the internal bore 26 of the insert. The insertion of the cogs 66 in the punch insert slots 36 retains the punch inserts 12 in their respective radially adjusted positions inside the radial holes 44 of the punch wheel. The punch inserts 12 can only be removed from the punch wheel radial holes 44 by disengaging the retainer ring cogs 66 from the punch wheel slot 52 and the slots 36 of the punch inserts.

The retainer ring 16 and punch wheel 14 are held in their respective assembled positions, with the cogs 66 of the retainer ring engaging in the punch insert slots 36, by the clamping collar 18 and the key 22. The clamping collar 18 is formed as an annular ring having a center bore defined by an annular inner surface 72 and having an external peripheral surface 74. A gap 76 is cut through the clamping collar between the inner and peripheral surfaces 72, 74. A chordal hole 78 extends through the clamping collar perpendicular to the gap 76. Portions of the chordal hole 78 on both sides of the gap 76, are screw threaded and a recess 82 is formed at one end of the chordal hole. A screw threaded fastener 84 is received in the screw threaded portions of the chordal hole 78 and the head 86 of the fastener is received in the recess 82 of the hole. A small groove 92 is formed in a lateral side 94 of the clamping collar 18 extending radially from the clamping collar inner surface 72.

The key 22 has a narrow, elongate middle section 96 and a pair of legs 98, 102 that project normally from opposite ends of the middle section. The key legs 98, 102 are dimensioned to engage in both the clamping collar radial groove 92 and the punch wheel radial groove 56 to secure the clamping collar and the punch wheel on opposite sides of the retainer ring.

The mandrel has a cylindrical middle section 104 and a pair of journal shafts (not shown) that project from the opposite ends of the middle section. A keyway 106 is cut in the exterior surface of the mandrel middle section. The keyway 106 extends axially over the middle section between its opposite ends (not shown).

The component parts of the invention are assembled on the rotary mandrel 24. In assembling the component parts of the invention, the plurality of punch inserts 12 are first inserted in the radial holes 44 of the punch wheel 14. The inserts are positioned in the punch wheel with the cutting annular rims 34 of the inserts projecting from the peripheral surface 46 of the wheel, and with the insert slots 36 coinciding with the annular slot 52 of the punch wheel.

The retaining ring 16 is next assembled to the punch wheel and mounted punch inserts. The ring is positioned adjacent the wheel with the cogs 66 of the ring pointing toward the punch wheel annular slot 52, and with the center bore of the ring aligned with the center of the wheel. The cogs 66 of the ring are inserted through the annular slot 52 of the punch wheel and are engaged in the slots 36 of the inserts mounted on the punch wheel. Engaging the individual cogs 66 of the retainer ring in the slots 36 of the inserts 12 mounted in the punch wheel 14 secures all of the inserts relative to the punch wheel with the cutting rims 34 of the inserts set at a predetermined radial extension from the punch wheel perimeter.

The clamping collar 18 is next positioned adjacent the retaining ring 16 with the center bore of the clamping collar aligned with the center bores of the connected retaining ring 16 and punch wheel 14. The collar lateral surface 94 having the radial groove 92 formed therein is positioned facing away from the retainer ring 16.

The relative positions of the assembled punch inserts 12, punch wheel 14, retaining ring 16 and clamping collar 18 thus far described are best seen in FIG. 3. In the relative positions of the punch wheel, retaining ring and clamping collar shown in FIG. 3, the inner diameters of the wheel, ring and collar are coextensive.

In the relative positions of the punch wheel 14, the retainer ring 16 and clamping collar 18 shown in FIG. 3, the key 22 is inserted through the centers of the wheel, ring and collar. The opposite legs 98, 102 of the key are engaged in the radial grooves 92, 56 of the clamping collar 18 and punch wheel 14, respectively. With the key 22 so inserted, the key secures the clamping collar 18 to the punch wheel 14, and secures the retaining ring 16 between the clamping collar and punch wheel.

The assembled key 22, clamping collar 18, retainer ring 16 and punch wheel 14 are next assembled on the exterior surface 104 of the rotary mandrel 24. The key 22 is aligned with the mandrel keyway 106 at one end (not shown) of the mandrel middle section 104, and the key 22, together with the assembled clamping collar 18, retainer ring 16 and punch wheel 14, are slip fit over the end of the mandrel middle section 106. The engagement of the key 22 in the mandrel keyway 106 prevents relative rotation between the mandrel and the key, clamping collar, retainer ring and punch wheel. The assembled key, clamping collar, retainer ring and punch wheel of the die assembly are slipped axially over the mandrel exterior surface 104 to their desired axial position on the mandrel. The assembled die assembly is then secured in its adjusted axial position on the mandrel by tightening the screw threaded fastener 84 of the clamping collar 18. In this manner, the plurality of punch inserts 14 are secured in a desired axial position on the rotary mandrel 24. Due to the unique construction of the rotary hole punching die assembly of the invention, none of the punch inserts 12 can be removed from the assembly without first removing the entire assembly from the press.

The mandrel is then assembled to a rotary die cutting press adjacent to a cooperating anvil roll of the press. As the mandrel is rotated by the press, the plurality of hole punch inserts 12 mounted in the die assembly cut holes in sheets of material passed between the mandrel and anvil roll.

While the present invention has been described by reference to a specific embodiment, it should be understood that modifications and variations of the invention may be constructed without departing from the scope of the invention defined in the following claims.

What is claimed is:

1. A rotary hole punching die assembly comprising:

a rotary mandrel;

an annular wheel slip fit on the mandrel;

a plurality of hole punch inserts mounted on the annular wheel, the plurality of hole punch inserts being spatially arranged around a circumference of the annular wheel;

a retainer ring slip fit on the mandrel, the retainer ring having a plurality of cogs spacially arranged around a circumference of the retainer ring, each cog of the plurality engaging a hole punch insert of the plurality of hole punch inserts mounted on the annular wheel;

a clamping collar slip fit on the mandrel, the clamping collar being releasably secured on the mandrel; and, a key extending between the annular wheel, the retainer ring and the clamping collar on the mandrel, the key releasably securing the annular wheel, the retainer ring and the clamping collar together on the mandrel.

2. A rotary hole punching die assembly for a rotary hole punch press, the assembly comprising:

a rotary mandrel mountable for rotation on the rotary press;

a plurality of hole punch inserts for cutting holes through a sheet of material;

a punch wheel receiving the plurality of hole punch inserts and holding the plurality of hole punch inserts in a spaced arrangement on the punch wheel;

a retaining ring engaging against and retaining at least two hole punch inserts of the plurality of hole punch inserts on the punch wheel; and a clamping collar for securing the punch wheel on the rotary mandrel.

3. The assembly of claim 2, wherein:

the retaining ring retains all of the plurality of hole punch inserts on the punch wheel.

4. The assembly of claim 2, wherein:

the retaining ring releasably retains all of the plurality of hole punch inserts on the punch wheel.

5. The assembly of claim 2, wherein:

the clamping collar secures the punch wheel and the retaining ring on the rotary mandrel.

6. The assembly of claim 5, wherein:

the clamping collar secures the punch wheel to the retaining ring.

7. The assembly of claim 2, wherein:

the punch wheel, the retaining ring, and the clamping collar are slip fit on the rotary mandrel, and the clamping collar releasably secures the punch wheel and the retaining ring against rotational and axial movement relative to the mandrel.

8. The assembly of claim 7, wherein:

a key is connected between the punch wheel and the clamping collar on the rotary mandrel and secures the punch wheel on the rotary mandrel.

9. The assembly of claim 8, wherein:

the retaining ring is slip fit on the rotary mandrel between the punch wheel and the clamping collar.

10. The assembly of claim 2, wherein:

the punch wheel has a peripheral surface and a plurality of holes extend radially into the peripheral surface.

11. The assembly of claim 10, wherein:

the plurality of holes are spacially arranged equidistant from each other around the peripheral surface of the punch wheel.

12. The assembly of claim 10, wherein:

the plurality of hole punch inserts are received in the plurality of holes in the peripheral surface of the punch wheel.

13. The assembly of claim 12, wherein:

the retaining ring engages with the plurality of hole punch inserts received in the plurality of holes in the punch wheel and retains the plurality of hole punch inserts in the plurality of holes in the punch wheel.

14. The assembly of claim 2, wherein:

the retaining ring is an annular ring that is slip fit on the rotary mandrel, the ring has a plurality of cogs circumferentially arranged around the ring, and the plurality of cogs engage the plurality of hole punch inserts received by the punch wheel and retain the plurality of hole punch inserts on the punch wheel.

15. The assembly of claim 14, wherein:

the plurality of hole punch inserts received by the punch wheel and retained on the punch wheel by the retaining ring cogs cannot be removed from the punch wheel without first removing the retaining ring and punch wheel from the mandrel and then removing the retaining ring cogs from the plurality of inserts.

16. The assembly of claim 15, wherein:

the retaining ring and punch wheel cannot be removed from the mandrel while the mandrel is mounted on the hole punching press.

17. A rotary hole punching die assembly for a rotary hole punching press, the assembly comprising:

a rotary mandrel mountable for rotation on the rotary press;

a hole punch means for cutting holes in a sheet of material;

mounting means for receiving and supporting the hole punch means, the mounting means being mountable on the mandrel;

retaining means for retaining the hole punch means received by the mounting means on the mounting means, the retaining means being mountable on the mandrel; and clamping means including a clamping collar for securing the mounting means and the retaining means on the rotary mandrel, the hole punch means received by the mounting means and retained on the mounting means by the retaining means being inseparable from the mounting means while the mounting means and retaining means are secured on the mandrel by the clamping collar.

18. The assembly of claim 17, wherein:

the mounting means, the retaining means, and the clamping collar are slip fit on the rotary mandrel.

19. The assembly of claim 18, wherein:

the mounting means and the clamping collar are positioned on opposite sides of the retaining means on the rotary mandrel.

20. The assembly of claim 17, wherein:

the hole punch means includes a plurality of hole punch inserts, and the retaining means engages against and retains each of the plurality of hole punch inserts received in the mounting means on the mounting means.

21. The assembly of claim 20, wherein:

the mounting means is an annular wheel with a peripheral surface and a lateral side, a plurality of holes extend into the peripheral surface, and an annular slot extends into the lateral side.

22. The assembly of claim 21, wherein:

the plurality of hole punch inserts are received in the plurality of holes in the peripheral surface of the wheel, and the retaining means extends into the annular slot in the wheel lateral side and engages the plurality of hole punch inserts.

23. The assembly of claim 22, wherein:

the retaining means is an annular ring having a plurality of cogs circumferentially arranged around the ring, the plurality of cogs extend into the annular slot in the wheel lateral side and engage the plurality of hole punch inserts.

24. The assembly of claim 17, wherein:

the clamping collar is engagable with the mounting means to secure the retaining means between the clamping collar and the mounting means.

25. The assembly of claim 17, wherein:

the clamping means further includes a key, the key connects the mounting means to the clamping collar.

26. The assembly of claim 25, wherein:

the clamping collar and the key are releasably securable on the rotary mandrel, with the key inserted in an axial slot in the rotary mandrel and the clamping collar slip fit over the rotary mandrel and the key.

27. The assembly of claim 26, wherein:

the mounting means, the retaining means, and the clamping collar are slip fit over the rotary mandrel and the key.

28. The assembly of claim 25, wherein:

the key engages the clamping collar and the mounting means and secures the retaining means between the clamping collar and the mounting means on the rotary mandrel.

29. The assembly of claim 17, wherein:

the retaining means and mounting means cannot be removed from the rotary mandrel while the mandrel is mounted on the hole punching press.

* * * * *